US006134745A

United States Patent [19]

Wörwag

[11] Patent Number: 6,134,745

[45] Date of Patent: Oct. 24, 2000

[54] VACUUM CLEANING TOOL HAVING A BRUSH ROLLER THAT CAN BE PIVOTED OUT

[75] Inventor: Peter Wörwag, Romanshorn, Switzerland

[73] Assignee: Dupro AG, Switzerland

[21] Appl. No.: 09/249,686

[22] Filed: Feb. 12, 1999

[30] Foreign Application Priority Data

Feb. 13, 1998 [DE] Germany ..... 198 05 900

[51] Int. Cl.[7] ..... A47L 5/34; A47L 9/04

[52] U.S. Cl. ..... 15/355; 15/368; 15/383

[58] Field of Search ..... 15/383, 368, 377, 15/354, 355

[56] References Cited

U.S. PATENT DOCUMENTS

| | | | |
|---|---|---|---|
| 1,953,340 | 4/1934 | Doemling | 15/377 |
| 2,432,086 | 12/1947 | Boisselier | 15/368 |
| 3,100,907 | 8/1963 | Schwertl | 15/377 |
| 3,172,138 | 3/1965 | Price | 15/98 |
| 3,671,996 | 6/1972 | Gaudry | 15/368 |
| 4,361,929 | 12/1982 | Jinkins | 15/355 |
| 4,384,386 | 5/1983 | Dorner et al. | 15/377 |
| 4,570,278 | 2/1986 | Bloome et al. | 15/97.1 |
| 4,875,246 | 10/1989 | MacGregor | 15/50.3 |
| 4,951,347 | 8/1990 | Star et al. | 15/340.3 |
| 5,014,386 | 5/1991 | Worwag | 15/339 |
| 5,765,258 | 6/1998 | Melito et al. | 15/352 |

FOREIGN PATENT DOCUMENTS

| | | |
|---|---|---|
| 69 13 820 | 4/1969 | Germany . |
| 37 37 568 Al | 5/1989 | Germany . |

*Primary Examiner*—Theresa T. Snider
*Attorney, Agent, or Firm*—Robert W. Becker & Associates

[57] ABSTRACT

A vacuum cleaning tool, especially a suction nozzle for the floor, is provided. The tool includes a housing having a suction chamber that is connected to a vacuum cleaning unit by a connector. Disposed in the suction chamber is a brush roller, the bristles of which extend through a suction opening. The brush roller is rotatably disposed in the housing between lateral mounting pieces, which are held by respective pivot arms in such a way on a pivot element provided in the housing that the brush roller can be pivoted out of the suction chamber about a pivot axis that is disposed approximately parallel to the brush roller. One of the pivot arms is detachably connected with the pivot element via a plug connection, which is provided with electrical plug contacts via which the electrical line of an electric drive motor disposed in the brush roller can be connected with an external power source.

12 Claims, 8 Drawing Sheets

1
3
12
9
6
36
20
8
29
37
2
16
15
14
28
65
27
25
26
21
B

VACUUM CLEANING TOOL HAVING A BRUSH ROLLER THAT CAN BE PIVOTED OUT

BACKGROUND OF THE INVENTION

The present invention relates to a vacuum cleaning tool, especially a suction nozzle for the floor. The tool has a housing with a suction chamber that is connected to a vacuum cleaning unit by a connector. A suction opening of the housing extends essentially over the entire dimension of the suction chamber. A brush roller is disposed in the suction chamber with the bristles thereof extending out through the suction opening. The brush roller is rotatably disposed in the housing between lateral mounting pieces. Via respective pivot arms, the mounting pieces are held on a pivot element that is provided in the housing such that the brush roller is pivotable out of the suction chamber about a pivot axis that is disposed approximately parallel to the brush roller.

A vacuum or suction cleaning tool of this type is disclosed in U.S. Pat. No. 2,432,086. The rotatingly driven brush roller that is disposed in the suction chamber achieves good cleaning results. However, in practice problems arise if threads, filaments or the like become wound about the brush roller or if objects that are sucked in clog the suction channels. For cleaning purposes, the brush roller is pivoted out of the suction chamber by the pivot arms, with the pivot arms being held on the housing by elements such as bolts. In the pivoted-out position of the brush roller, the periphery thereof as well as the suction opening of the housing are easily accessible. However, the outer belt drive of the brush roller gets in the way and prevents acess.

It is therefore an object of the present invention to improve a vacuum cleaning tool of the aforementioned general type in such a way that despite the presence of the drive means for the brush, a rapid and simple cleaning of the brush roller and the suction passages is possible by providing good accessibility to the brush roller and to the suction openings provided in the housing.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The vacuum cleaning tool of the present invention is characterized primarily in that one of the pivot arms is detachably connected with the pivot element by means of a plug connection, whereby the plug connection has electrical contacts via which the electrical line of an electric drive motor that is disposed in the brush roller can be connected with an external power source.

Since one of the pivot arms is detachably connected with the pivot elements via a plug connection, the brush roller can be easily detached at this axial end from the vacuum cleaning tool, and at its other end can be axially pulled out of its support in the mounting piece. The brush roller is thus removable from the vacuum cleaning tool without a special tool. The electrical drive motor that is disposed in the brush roller is connected with an external power source via electrical plug contacts, so that at the same time that the pivot arm is detached the electrical connection is separated and thus cannot disrupt any of the parts of the drive mechanism during disassembly.

The mounting piece that is connected with the detachable pivot arm is expediently fixedly connected with the interior motor of the brush roller, whereby the electrical line is advantageously guided through the hollow pivot element, the mounting piece and the associated pivot arm.

In their operating position, when they are pivoted into the suction chamber, the mounting pieces are secured by pins or studs that are fixed to the housing and that are advantageously formed by extending mounting studs or journals that extend into the suction chamber and are part of a glide bottom that is pivotably held on the housing. The glide bottom itself, and/or the extended journals thereof, secure the pivotable brush roller in its operating position, so that only when the glide bottom is pivoted out of the suction opening is it possible to pivot the brush roller through the suction opening of the suction chamber.

Further specific features of the present invention will be described in detail subsequently.

DESCRIPTION OF PREFERRED EMBODIMENTS

Figure 1:
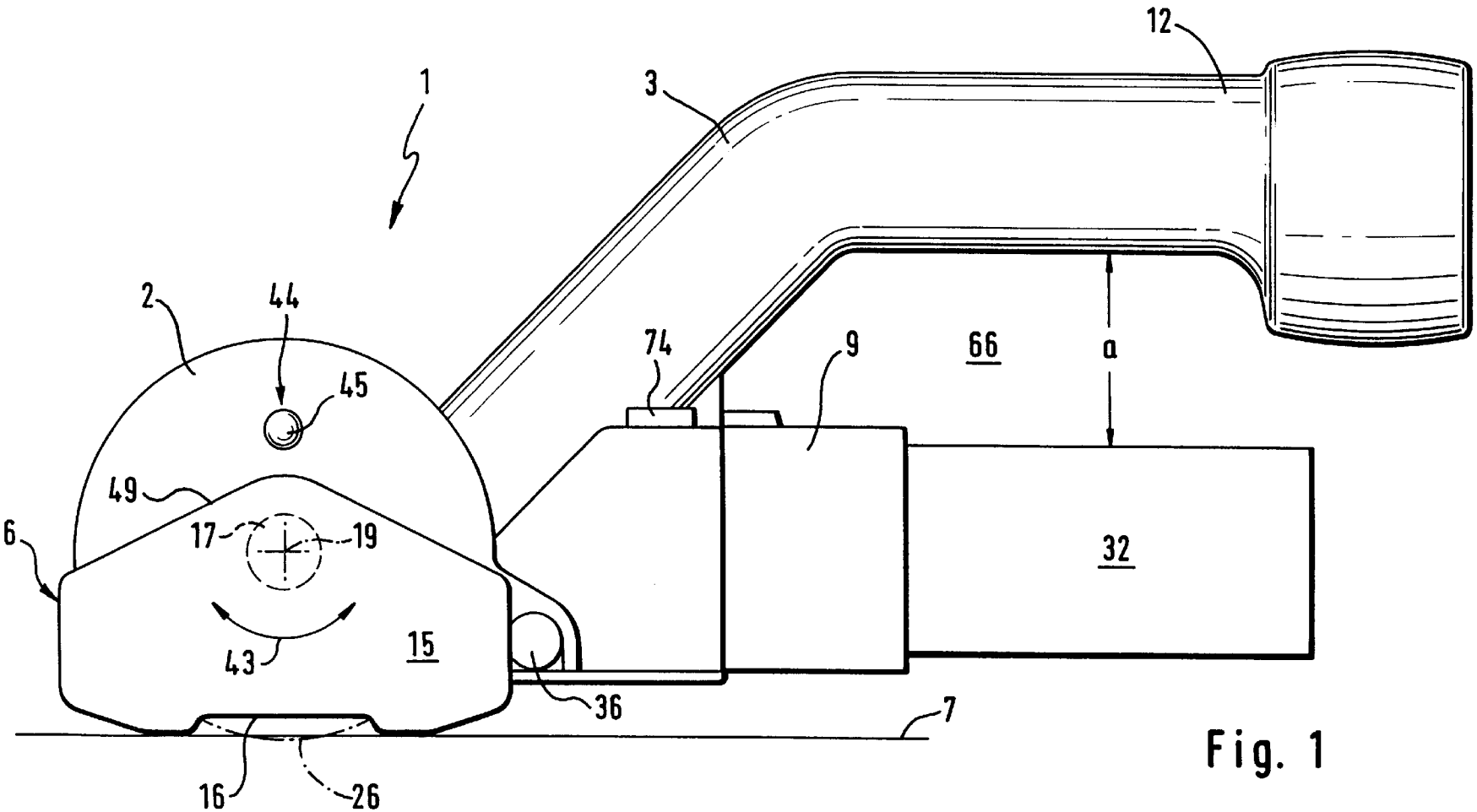
FIG. 1 is a side view of one exemplary embodiment of the inventive vacuum cleaning tool.
Figure 4:
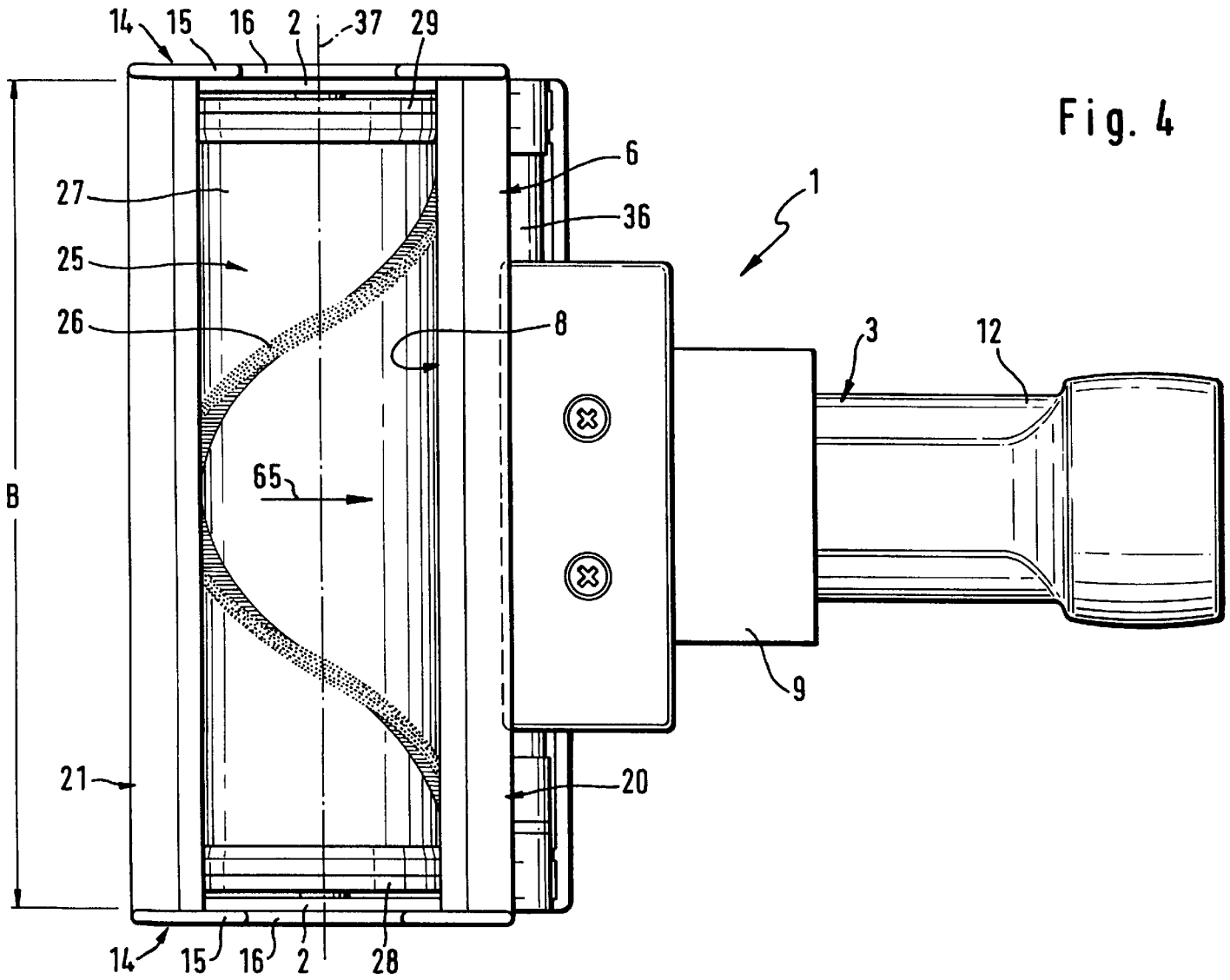
FIG. 4 is a bottom view of the vacuum cleaning tool of FIG. 1.

Referring now to the drawings in detail, in the illustrated embodiment the vacuum cleaning tool illustrated in FIGS. 1 and 4 is a suction nozzle 1 for the floor. This suction nozzle has a housing 2 that defines a suction chamber 4. In the illustrated embodiment the housing 2 has an essentially cylindrical configuration and is disposed transverse to a connector 3 that is formed on the cylindrical surface and is disposed approximately centrally relative to the cylinder of the housing 2. The connector 3 serves for connecting the suction nozzle 1 to a non-illustrated vacuum cleaner. As can be seen from the side views of FIGS. 1 and 2, the connector 3 is expediently angled off, with the end portion 12, which is disposed approximately horizontally relative to the surface 7 of the floor, being advantageously embodied as a hand grip for holding and guiding the floor nozzle 1. For this purpose, as can be seen from the cross-sectional view of FIG. 3, the cross-section of the connector 3 is in the form of a flattened circle, with the peripheral portion 12*a* that is directed toward the ball of the thumb of the user being rounded, and the peripheral section 12*b* that is grasped by the fingers being flat. In this connection, in the operating position of the floor nozzle 1 the peripheral portion 12*b* is disposed approximately parallel to the surface 7 of the floor.

Figures 2, 3:
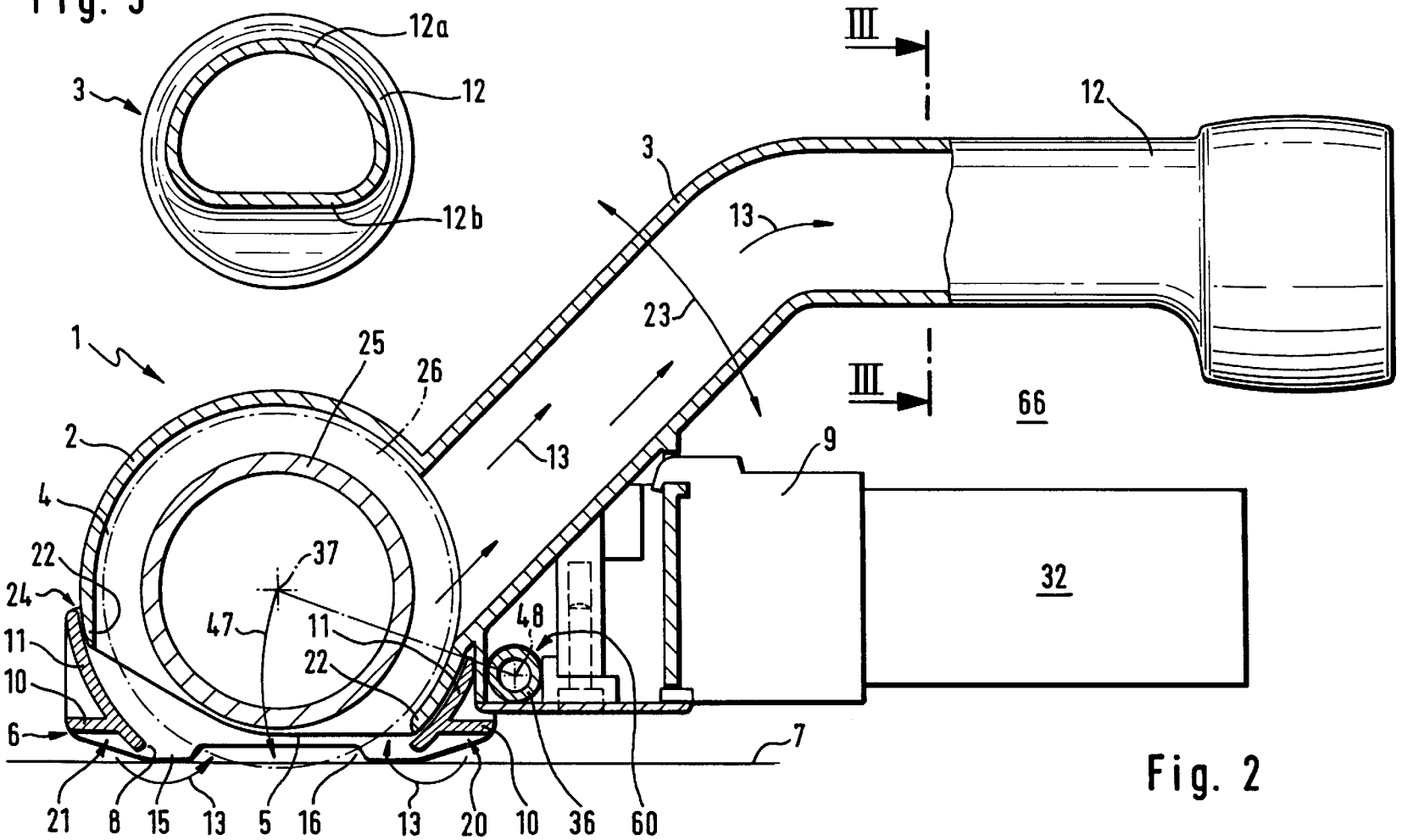
FIG. 2 is a cross-sectional view taken through the vacuum cleaning tool of FIG. 1.
FIG. 3 is a cross-sectional view taken along the line of III—III in FIG. 2.

Over the entire axial width B (see FIG. 4) the suction chamber 4 that is formed in the housing 2 is open over about 110° of the periphery; the suction chamber thus has a suction opening 5 that faces the surface 7 of the floor that is to be cleaned. A glide bottom 6 is placed over the suction opening 5, which essentially extends over the entire span of the suction chamber 4. As can be seen in particular in FIG. 4, the glide bottom 6 has a suction slot 8 that extends over the entire width B of the housing 2; the suction slot 8 is essentially aligned with the suction opening 5. As can be seen in FIG. 2, the dirt-laden suction air stream 13 enters the suction opening 5 and the suction chamber 4 via the suction slot 8 of the glide bottom 6 and is withdrawn via the connector 3.

Figure 5:
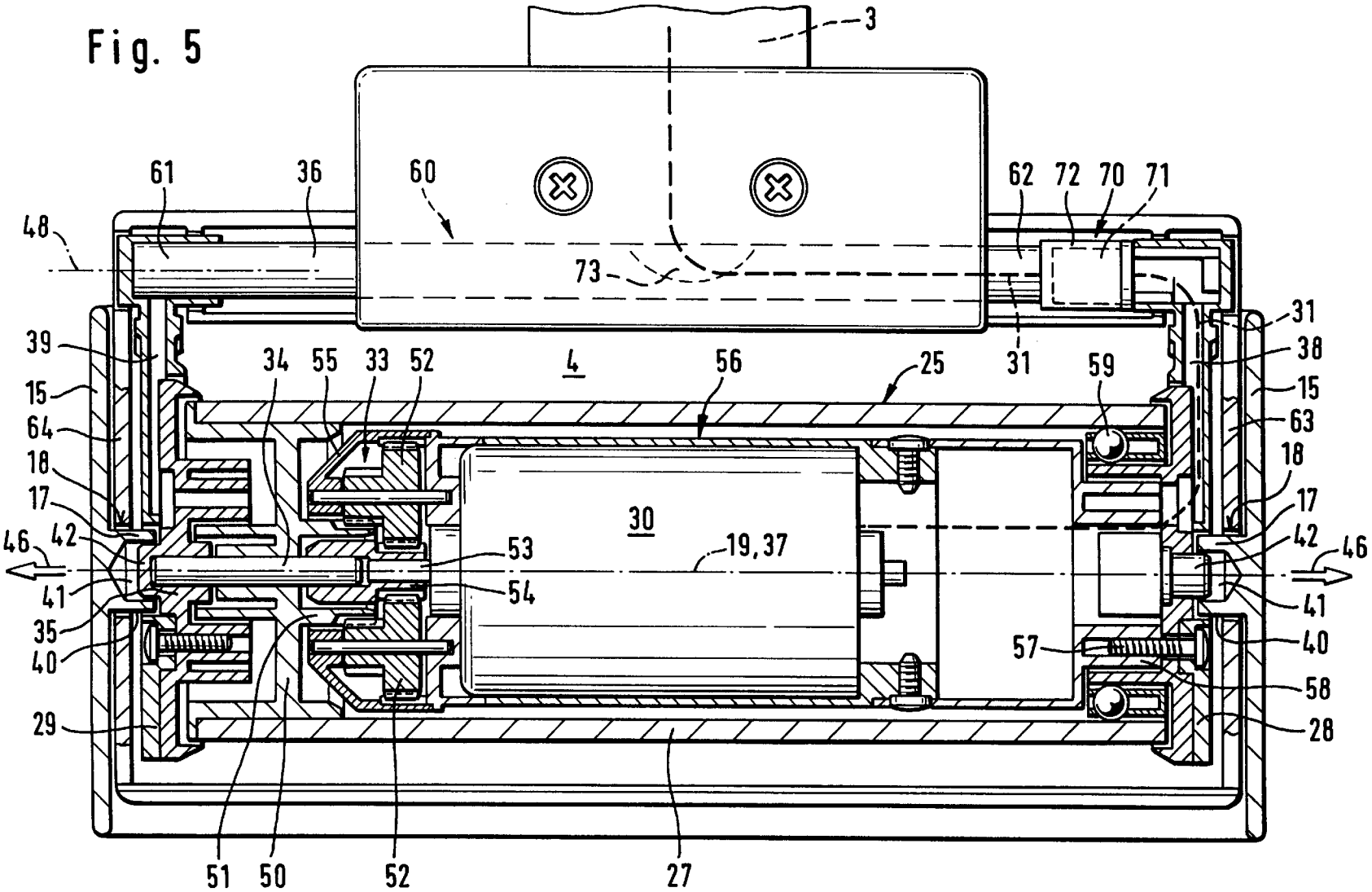
FIG. 5 is a partial cross-sectional view through the vacuum cleaning tool as shown in FIG. 4.

Disposed in the suction chamber 4 is a brush roller 25, the bristles 26 of which extend out through the suction opening 5 and the suction slot 8 in the glide bottom 6. As can be seen in FIG. 5, the brush roller 25 essentially comprises a cylindrical main body 27, one open end of which is closed off by a mounting plate 50 that is fixedly mounted in the main body. The mounting plate 50 has a central, hollow stud 51 that is directed into the interior of the brush roller 25; the outer surface of the hollow stud 51 is embodied as a gear wheel that meshes with the planetary gears 52 of a planetary gearing 33, which is driven by a drive gear 54 that is disposed on the motor shaft 53. The gearing 33 is disposed in a gear housing 55 that along with the motor 30 forms a structural unit 56 that by means of screws 57 is axially secured on a mounting piece 28. At that end 58 that faces the mounting piece 28 the structural unit 56 has a reduced diameter and carries a bearing ring 59, which in the illustrated embodiment is provided with a roller body in the form of bearing balls. The bearing ring 59 is spanned by the main body 27 and rotatably supports the same relative to the axis of rotation 37 between the mounting pieces 28 and 29. In the vicinity of the hollow stud 51, a shaft 34 that is fixedly connected with the motor shaft 53 extends centrally through the mounting plate 50. The free end of the shaft 34 engages a mounting means 35 that is provided in the mounting piece 29. At the gear end, the main body 27 is rotatably mounted on the shaft 34 via the hollow stud 51, with the free end of the shaft 34 being axially inserted into the mounting means 35 of the mounting piece 29 in such a way that it is easily removable. The mounting pieces 28 and 29 are connected via pivot arms 38 and 39 (see also FIG. 6) with a pivot element 36 which in the illustrated embodiment is a pivot shaft. The pivot shaft 36 is held in a pivot mount 60 of the housing 2, whereby, as shown in FIG. 5, the free ends of the pivot shaft 36 extend out of the pivot mount 60. The pivot arm 39 is non-detachably secured to the one axial end 61 of the pivot shaft 36, while the other axial end 62 is provided with a plug connection 70 via which the pivot arm 38 can be axially connected with the pivot shaft 36. In the illustrated embodiment, the free end 62 of the pivot shaft 36 carries a socket or sleeve 72 (see also FIG. 8) into which a plug or insert 71 of the pivot arm 38 can be axially inserted. In this connection, the sleeve 72 is fixedly connected with the pivot shaft 36, so that the insert 71, which is fixedly connected with the pivot arm 38, can be inserted into a position that is fixed relative to the pivot shaft 36.

The pivot shaft 36 is preferably a hollow shaft that approximately in the middle has an opening 73 in its surface for an electrical supply line 31. For the detachable connection of the electrical line 31, the plug 70 has electrical contacts, whereby the line 31 is guided through the pivot arm 38 and the mounting piece 28 into the structural unit 56, where it is connected with the electric motor 30. The electrical line connects electrical contacts in a receiving shoe 9 (see FIGS. 1 and 2) with the motor 30; a battery pack 32 is replaceably disposed in the receiving shoe 9. An electrical switch 74 for turning the electric motor on and off is expediently disposed on the receiving shoe 9 in the housing 2.

By means of the pivot element 36, the mounting pieces 28, 29 together with the brush roller 25 can be pivoted out of the suction chamber 4 and the housing 2 through the suction opening 5 about a pivot axis 48 that is disposed approximately parallel to the brush roller 25. This is indicated in FIG. 2 by the arrow 47.

In order to secure the brush roller 25 in its pivoted-in position in the suction chamber 4 as shown in FIG. 2, pins that are fixed to the housing and that extend into the suction chamber 4 are provided; these pins or studs are formed by extended mounting studs or journals 17 of the glide bottom 6, which is pivotably held on the housing 2, with the journals 17 extending into the suction chamber 4.

The glide bottom 6, which when viewed in plan has an approximately rectangular shape, is provided at its narrow sides 14 with side pieces 15, the corners of which are interconnected by longitudinal pieces 20, 21. Each side piece 15 has an essentially rectangular contour, with that edge that faces the floor surface 7 having a preferably centrally disposed opening 16 that permits a lateral suction air acess into the suction slot 8 and the suction opening 5. At that edge 49 that is remote or opposite of the suction slot 8, the side piece 15 is embodied in such a way that it is inclined toward the longitudinal pieces 20, 21. The journal 17 is disposed approximately centrally in the vicinity of the inclined edges 49 and engages in a journal opening 18 formed in the side walls 63, 64 of the housing 2. Via the outer periphery 40, the journal 17 is pivotably held in the journal opening 18, whereby the free end of the journal 17 that extends into the suction chamber 4 has a central mounting hole 41 into which extends a facing mounting stud 42 of the respective mounting piece 28 or 29. By means of the journals 17, the glide bottom 6 that is held on the housing 2 of the suction nozzle 1 is movable relative to the housing 2 about a pivot axis 19 that is disposed approximately parallel to the axis of rotation 37 of the brush roller 25. In this connection, the pivot axis 19 of the glide bottom 6 is aligned with the axis of rotation 37 of the brush roller 25; the axes 19 and 37 are expediently also aligned with the cylinder axis of the housing 2.

As shown in FIG. 2, the longitudinal pieces 20 and 21 of the glide bottom 6 extend over the facing housing rim 22 of the suction opening 5, with each piece 20, 21 comprising a horizontal section 10 and a frame section 11. The frame section 11 expediently has the configuration of part of a cylinder, being adapted to the contour of the housing 2 and the opening rim 22, so that when the connector 3 is pivoted in the direction of the arrow 23, the housing rim 22 and the longitudinal pieces 20 and 21 carry out a relative movement while maintaining the same distance from one another. In all pivoted operating positions of the vacuum cleaning tool, i.e., when the glide bottom 6 is placed upon the floor surface 7 and the nozzle housing 2 assumes various positions, the housing rim 22 is overlapped by the longitudinal pieces 20 and 21 of the glide bottom 6 so that the suction air essentially enters the suction chamber 4 through the suction slot 8 in the direction of the arrows 13. In this connection, the housing 2 of the suction nozzle 1 is disposed within the framelike glide bottom 6. The clearance of motion required between the moving parts necessitates a small gap 24 through which non dirt-laden air is drawn in from the atmosphere above the nozzle housing 2 but does not hinder the vacuum operation of the suction nozzle 1, yet such a gap ensures the movability of the glide bottom 6 relative to the nozzle housing 2 over a long period of operation.

Figure 6:
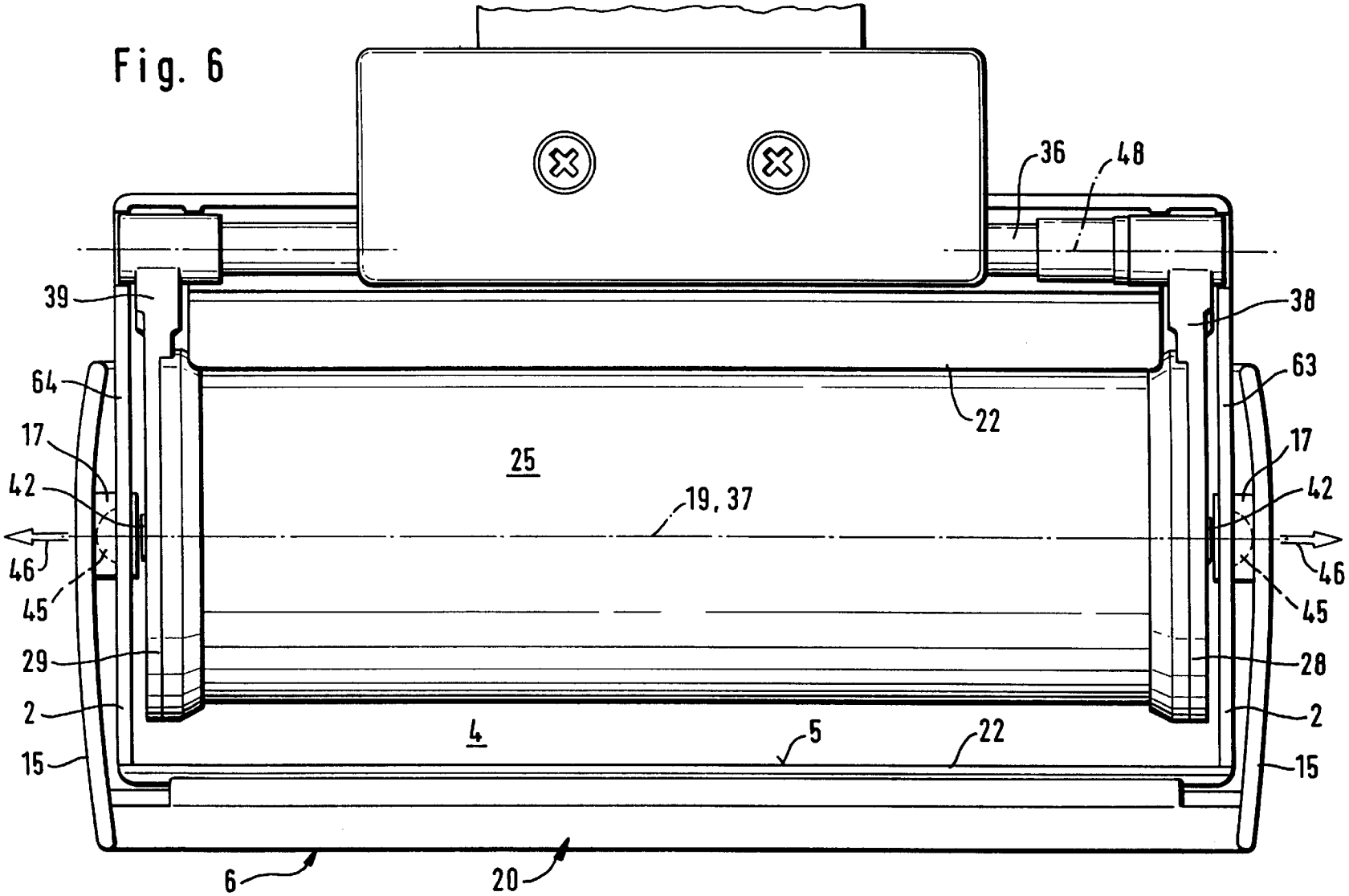
FIG. 6 is a partial bottom view of the vacuum cleaning tool with the glide bottom pivoted out of the suction opening.
Figure 7:
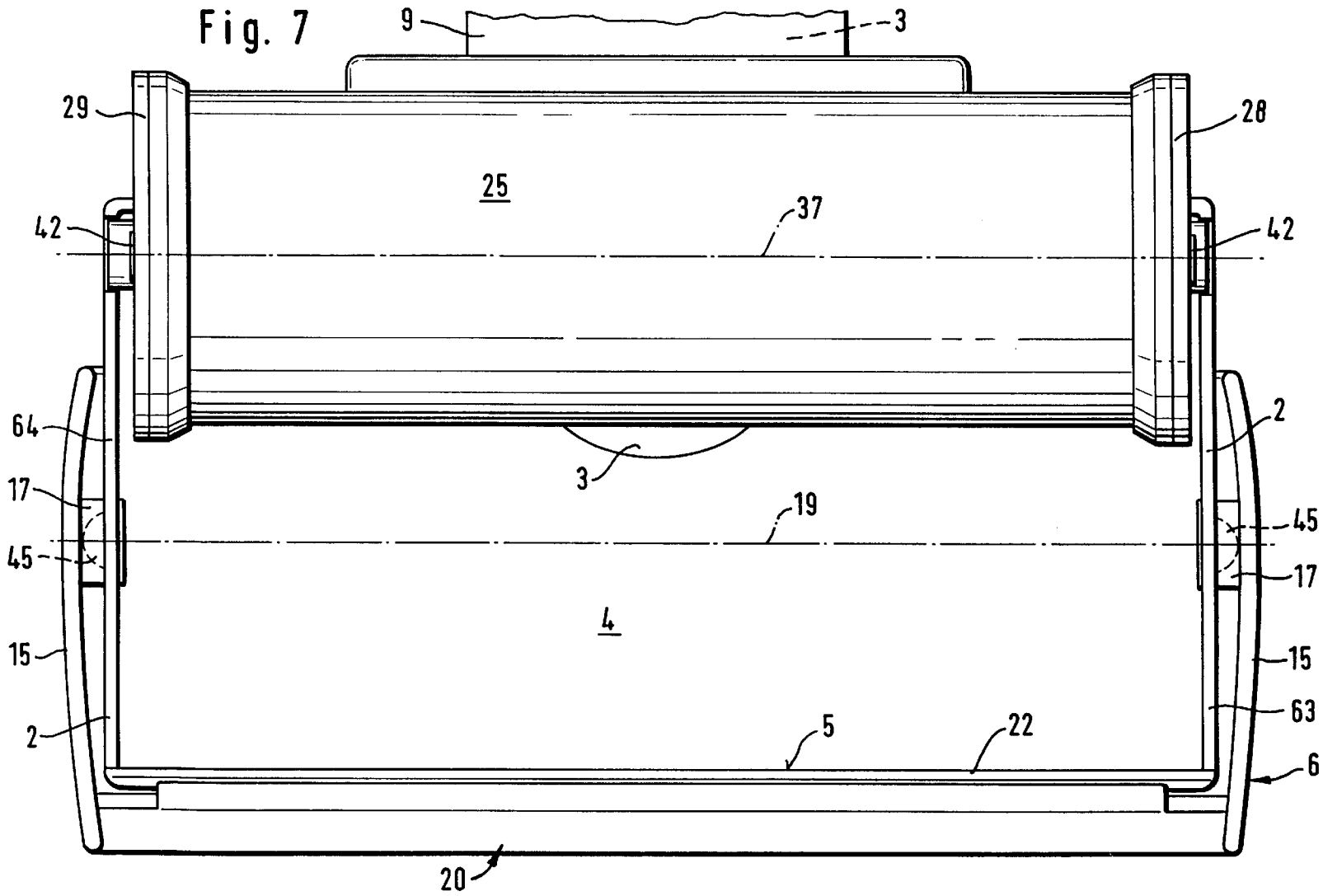
FIG. 7 is a view similar to FIG. 6 with the brush roller pivoted out of the suction opening.

In FIG. 1, the arrow 43 schematically illustrates that the glide bottom 6 can be pivoted out of the region of the suction opening 5, for example over an angle of about 110°. FIGS. 6 and 7 show such a pivot position of the glide bottom 6. In these pivot positions, the suction opening 5 is completely exposed, whereby at the same time by displacing the side pieces 15 in the direction of the arrows 46 the securement of the brush roller 25 to the housing is released. For this purpose, cam-like raised portions 44 (FIG. 1) are provided on the side walls 63 and 64; in the illustrated embodiment, these raised portions are in the form of knobs of material 45. With a pivoting over an angle of, for example, more than 90°, the side pieces 15 glide up upon the knobs 45, which are disposed near the pivot axis 19. As a result of the sliding of the side pieces 15 up upon the knobs of material 45 (FIGS. 6, 7) the side pieces 15 are axially and elastically deflected relative to the pivot axis 19 in the sense of being raised from the housing 2. As a consequence, the journals 17 are displaced in the direction of the arrows 46 (FIGS. 6, 7), namely axially outwardly, so that the journals 17 are withdrawn out of the suction chamber 4 and the mounting studs 42 of the mounting pieces 28 and 29 are released. The released brush roller 25 can be pivoted completely out of the suction chamber 4 about the pivot axis 48 through the suction opening 5, thus enabling an easy cleaning of the brush roller.

Figure 8:
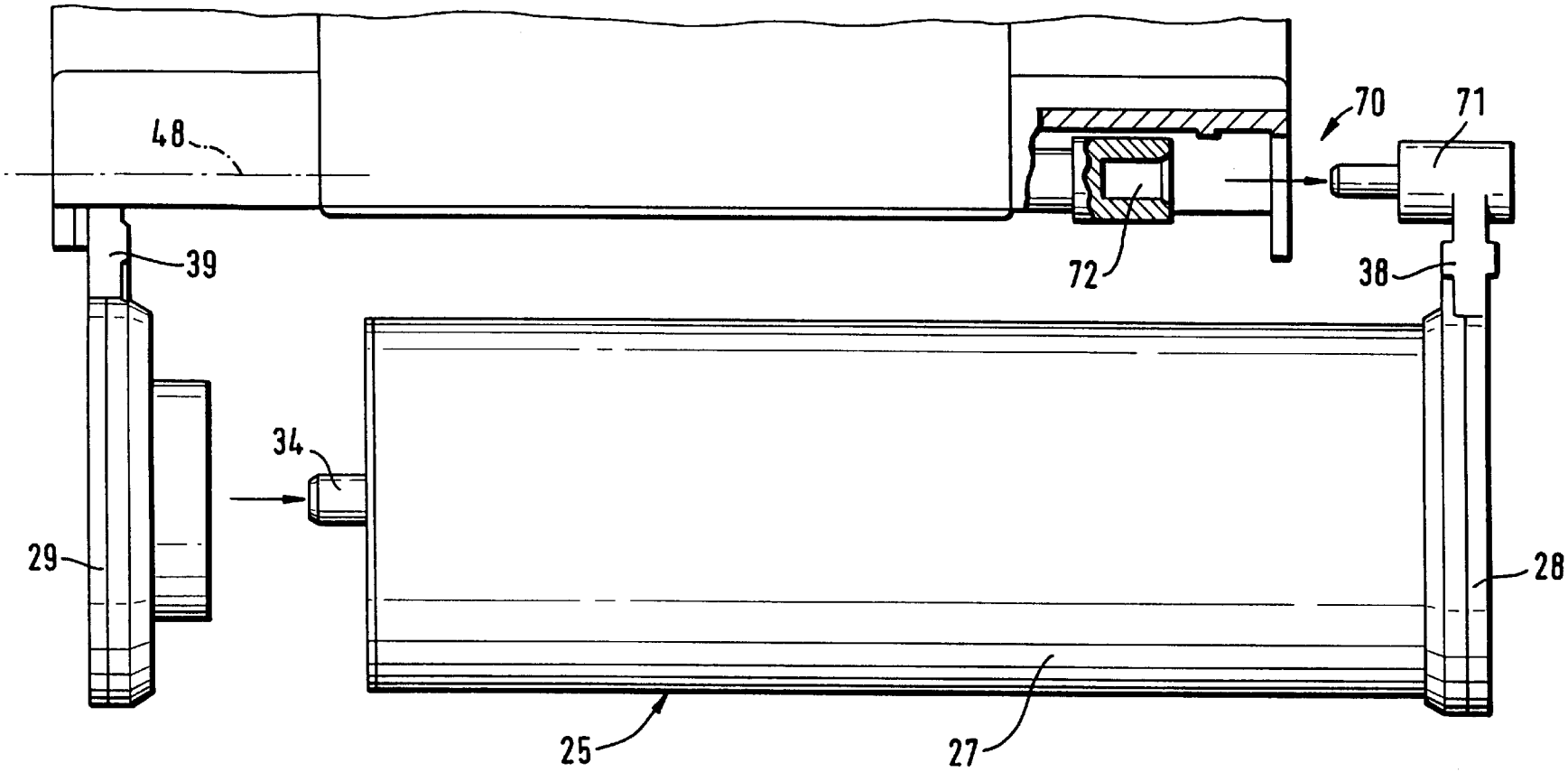
FIG. 8 is a view of the pivoted-out brush roller detached from the pivot element.
Figure 9:
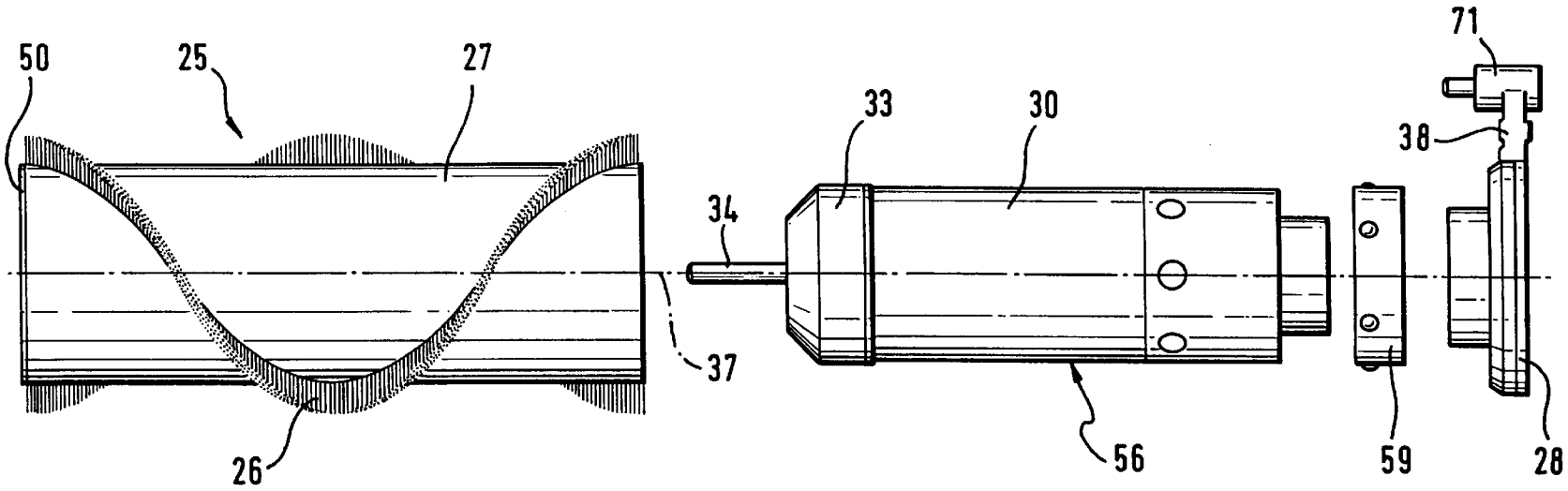
FIG. 9 is an exploded view of the individual components of the brush roller of FIG. 8.

As shown in FIG. 8 the brush roller 25 can be detached from the vacuum cleaning tool by pulling the insert 71 out of the sleeve 72 of the plug connection 70. At the same time, the free end of the shaft 34 is pulled out of the mounting means 35, as a result of which the brush roller, together with the drive unit, and separate from the tool, can be removed out of the floor suction nozzle 1, for example for maintenance, for replacement or the like. Since, as shown in FIG. 9, the main body 27 of the brush roller 25 can furthermore be axially withdrawn from the structural unit 56 and its drive motor 30, a replacement of the brush roller, for example when the bristles 26 become worn, is possible separate from the tool. Such an exchange or replacement can furthermore be undertaken rapidly and in a straightforward manner so that even an inexperienced person can accomplish such a replacement.

In this way, it is also possible to use main bodies 27 having different bristles. In the illustrated embodiment, for example, a brush roller 25 is provided that has a bristle arrangement where when viewed in plan the bristles are disposed in the manner of a V. In this connection, the V opens toward the front in the direction of rotation 65 of the brush roller 25, as a consequence of which good floor-cleaning results can be achieved. The inventive floor suction nozzle 1 is readily suitable for cleaning smooth floors since with the described brush roller 25 a good floor-cleaning effect is also achieved. This is also achieved in that the weight of the drive motor is uniformly distributed upon the bristles 26, and in addition a further bearing load is achieved due to the presence of the battery pack 32 without the need for the user to exert additional forces. In this connection, as shown in FIG. 1, the battery pack 32 is disposed by a distance "a" below the end portion 12 of the connector 3, with the end portion 12 and the battery pack 32 being disposed approximately parallel to one another. As shown in FIG. 4, the longitudinal central axes of the end portion 12 as well as of the receiving shoe 9 and battery pack 32 are aligned above one anther. The end portion 12 and the battery pack 32 thus provide a gripping space 66; this gripping space is closed relative to the floor surface 7 by the battery pack 32, so that the fingers of a user are protected.

The housing, the glide bottom, as well as the mounting pieces with the pivot arms are preferably made of polymeric material.

The specification incorporates by reference the disclosure of German priority document 198 05 900.00 of Feb. 13, 1998.

The present invention is, of course, in no way restricted to the specific disclosure of the specification and drawings, but also encompasses any modifications within the scope of the appended claims.

What is claimed is:

1. A vacuum cleaning tool comprising:

a housing in which is provided a suction chamber that communicates with a connector of said housing that serves for attachment to a vacuum cleaning unit, said housing having a suction opening that communicates with said suction chamber and essentially extends over the entire extension thereof;

a brush roller having bristles that extend out through said suction opening, said brush roller being rotatably disposed in said suction chamber between lateral mounting pieces, of said housing;

pivot arms, respectively holding said mounting pieces, mounted on a pivot element provided in said housing in such a way that said brush roller is pivotable out of said suction chamber about a pivot axis that is disposed approximately parallel to an axis of said brush roller, and a plug connection for detachably connecting one of said pivot arms with said pivot element, wherein said plug connection is provided with electrical contact means which establishes electrical contact between a drive motor disposed in said brush roller and an external power source.

2. A vacuum cleaning tool according to claim 1, wherein said plug connection is provided with a sleeve that is fixedly connected with said pivot element.

3. A vacuum cleaning tool according to claim 2, wherein the other of said pivot arms is non detachably fixedly held on said pivot element.

4. A vacuum cleaning tool according to claim 3, wherein said pivot element is a hollow shaft.

5. A vacuum cleaning tool according to claim 4, wherein a peripheral surface of said hollow shaft is provided with an opening for an electrical line.

6. A vacuum cleaning tool according to claim 5, wherein said electrical line is guided through said hollow shaft and in said one of said pivot arms as well as the associated mounting piece.

7. A vacuum cleaning tool according to claim 6, wherein said power source is a battery pack that is held on said housing.

8. A vacuum cleaning tool according to claim 7, wherein said battery pack is replaceable.

9. A vacuum cleaning tool according to claim 1, wherein the mounting piece that is connected to said one of said pivot arms is fixedly connected with said drive motor that is disposed in said brush roller.

10. A vacuum cleaning tool according to claim 1, wherein journals are provided on said housing for holding said mounting pieces, in an operative position, said operative position being when said brush roller is pivoted into said suction chamber.

11. A vacuum cleaning tool according to claim 10, which includes a glide bottom that is pivotably held on said housing , and wherein said journals are formed by extended journals on said glide bottom that extend into said suction chamber.

12. A vacuum cleaning tool according to claim 11, wherein said housing is provided with raised portions, wherein said journals are provided on outer side pieces of said glide bottom, and wherein when said glide bottom is pivoted into a non-operative position said side pieces glide up upon said raised portions and are elastically deformed via an axial retraction of said journals.

* * * * *